United States Patent [19]

Mitter

[11] 4,444,104

[45] Apr. 24, 1984

[54] APPARATUS FOR APPLYING A FOAMED TREATING MEDIUM TO A SUBSTRATE

[76] Inventor: Mathias Mitter, Schloss Holte, Fed. Rep. of Germany

[21] Appl. No.: 300,171

[22] Filed: Sep. 8, 1981

[30] Foreign Application Priority Data

Sep. 16, 1980 [DE] Fed. Rep. of Germany ..... 3034804

[51] Int. Cl.[3] ..... B41L 13/06

[52] U.S. Cl. ..... 101/119; 101/122; 101/124; 101/364; 118/414

[58] Field of Search ..... 118/213, 406, 414; 101/364, 120, 122, 119

[56] References Cited

U.S. PATENT DOCUMENTS

| | | | |
|---|---|---|---|
| 686,337 | 11/1901 | Read | 101/364 |
| 1,063,252 | 6/1913 | Fussganger | 101/364 |
| 2,333,382 | 11/1943 | Kent | 118/406 |
| 2,928,340 | 3/1960 | Stein | 118/406 |
| 3,084,661 | 4/1963 | Roberts | 118/406 |
| 3,464,382 | 9/1969 | Harriman | 118/406 |
| 4,023,487 | 5/1977 | Mitter | 101/120 |
| 4,275,656 | 6/1981 | Choma | 101/211 |

FOREIGN PATENT DOCUMENTS

| | | | |
|---|---|---|---|
| 2300290 | 7/1974 | Fed. Rep. of Germany | 101/122 |
| 2410753 | 9/1975 | Fed. Rep. of Germany | 101/364 |

*Primary Examiner*—Clyde I. Coughenour
*Attorney, Agent, or Firm*—Peter K. Kontler

[57] ABSTRACT

An apparatus for applying a treating medium to a screen has a container above the screen and a pipe which discharges foamed treating medium into the container from where an outlet leads to the screen. A foam generator supplies the foam and the pressure at which the foam enters the container can be regulated.

11 Claims, 5 Drawing Figures

APPARATUS FOR APPLYING A FOAMED TREATING MEDIUM TO A SUBSTRATE

BACKGROUND OF THE INVENTION

The present application relates to the application of a workpiece treating medium to a screen.

More particularly, the invention relates to apparatus for applying a workpiece treating medium to a screen.

Still more specifically, the present invention relates to apparatus for applying workpiece treating medium to a space which is open to the screen, and means for controlling the pressure under which the medium is applied.

Basic apparatus for this purpose are already known from the screen-printing art, where so-called slit or box squeegees are placed superjacent to a printing screen and the liquid or pasty printing ink is admitted into the interior of the squeegee (compare German Patent No. 2,300,290).

It is also known that the treating medium may be printing ink that has been converted to foamed state (compare German Published Application OS 2,523,062).

The use of treating medium—the term is used herein not merely in relation to printing ink but relative to any foamable medium that can be applied to a workpiece, e.g. fireproofing liquid, mothproofing liquid, appearance-enhancing liquid, etc.—in foamed condition has the advantage of much more uniform application of the medium to the workpiece than would otherwise be the case. The reason is that each foam bubble contains only a small amount of the liquid which it yields when it bursts, so that uniform application is assured. On the other hand, a prerequisite of success with foamed treating medium is that a screen be interposed between it and the workpiece. The workpiece surface is never as uniform as the screen surface and it is this factor which assures uniform bursting of the foam bubbles at the foam/screen interface.

OBJECTS AND SUMMARY OF THE INVENTION

The prior art devices are found to be in need of further improvement and it is, therefore, an object of the present invention to provide such improvement.

A more particular object is to provide an improved apparatus of the type in question wherein a uniform application of the treating medium to the workpiece is assured.

A concomitant object of the invention is to provide such an apparatus which is capable of conforming to the absorption capacity of the particular workpiece being treated.

In pursuance of the above objects, and still others which will become apparent hereafter, one feature of the invention resides in the provision of an apparatus for applying a workpiece treating medium to a screen, comprising a screen adapted to be superjacent to a workpiece; first means defining above the screen an enclosed space having an opening towards the screen; second means communicating with the space for admitting a foamed treating medium into the same; third means for foaming a treating medium; and fourth means for supplying the foamed treating medium under adjustable pressure to the second means.

The supply of foam in the apparatus may be manually and/or automatically controllable. The setting that is chosen can be readily empirically determined by those skilled in the art, since it depends upon the quality of coating (or print) to be applied to the workpiece, so that the regulation is simply carried out until the coating (or print) quality is found to be satisfactory.

The invention will hereafter be described with reference to exemplary embodiments. However, it is to be understood that the authoritative definition of the protection sought for the invention is to be found only in the scope of the appended claims.

DESCRIPTION OF PREFERRED EMBODIMENTS

Figure 1:
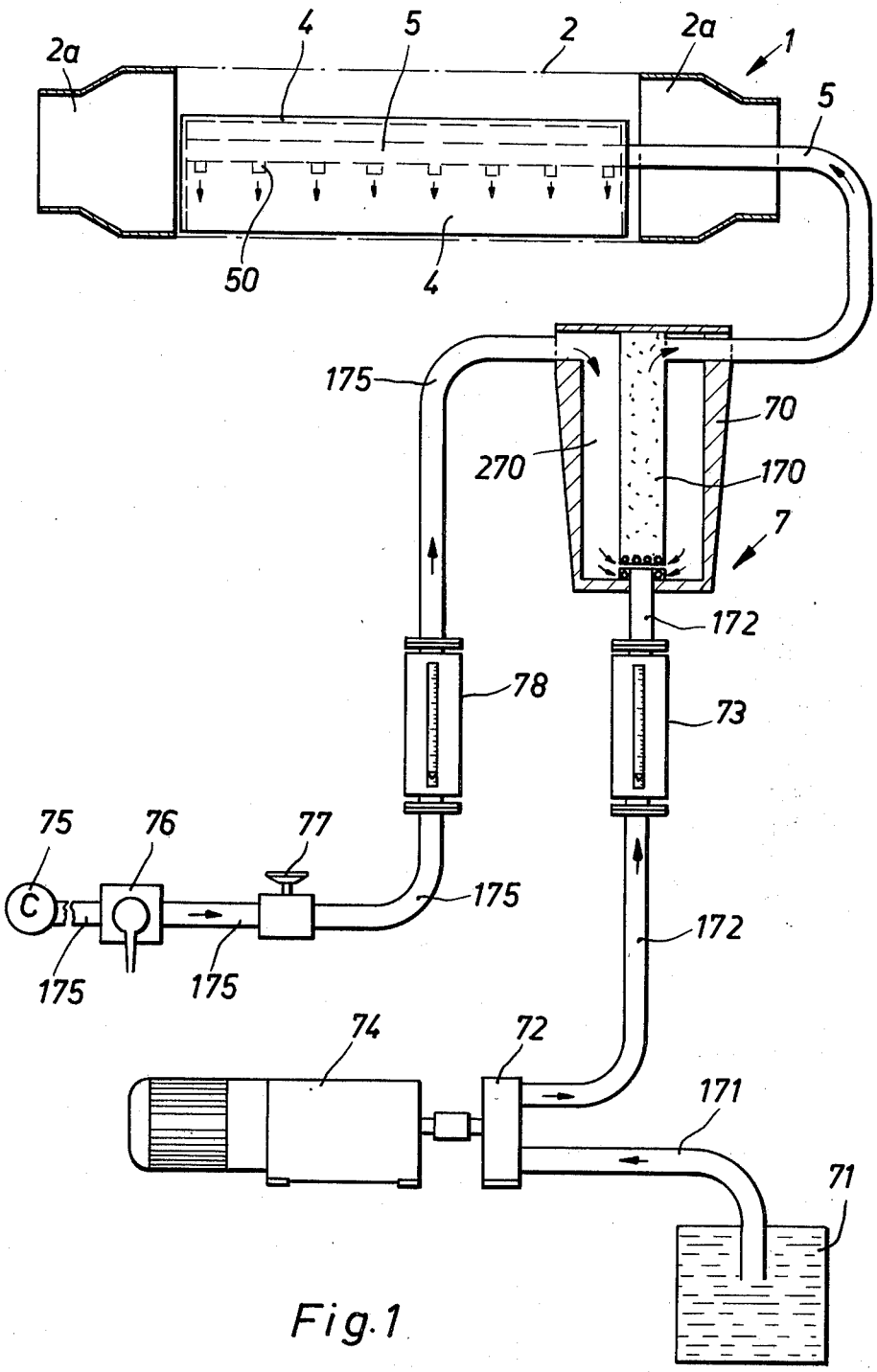
FIG. 1 is a somewhat diagrammatic side elevational view, illustrating an apparatus embodying the invention, including the foam generator.

FIG. 1 illustrates, in diagrammatic form, a drum-type rotary printing screen 2 of the printing station 1 of a screen printing machine, provided with end rings *2a* which give the screen form stability. It should be noted in this connection that although for the sake of convenience the invention will be described herein with reference to screen printing, it is not limited thereto. Also, it is not limited to rotary printing screens but is applicable to endless belt-type screens as well as to flat screens, any of which may move or be stationary.

Located in the interior of the drum-type screen 2 in FIG. 1 is a container 4 which cooperates with a device 5 (here a pipe located in the container) through which foamed treating medium (e.g. printing ink) is supplied into the container 4. The device 5 receives the foam from a foam generator 7 which is known per se. Device 5 may also terminate at one end of the container 4 or else extend over the entire length of the same (as shown) and have outflow nipples 50 for the foam.

The foam generator 7 is composed of three basic main elements, the liquid medium supply, the compressed air supply and a mixing head. The liquid treating medium (e.g. water and ink) is accommodated in a reservoir 71 and mixed with a commercially available foaming agent. From there it is withdrawn via a conduit 171 by a gear pump 72 (driven by gear motor 74) and supplied via conduit 172 with an interposed flow meter 73 to the mixing head 70, or rather into a mixing container 170 which is located in the interior of the mixing head and is surrounded by an annular space 270.

Compressor 75 supplies compressed air into the annular space 270 via a conduit 175 in which a shut-off valve 76, a pressure reducing valve 77 and a flow meter 78 are interposed. The flow meters 73 and 78 may be provided with automatic regulators (known per se) so that the once selected values (i.e. flow-through quantity per unit of time) are automatically maintained. The compressed air enters from space 270 through holes at the bottom of container 170; the latter may contain glass spheres, granulate or a similar filling to promote the formation of foam, which results from the air being blown under pressure into the liquid from reservoir 71 which liquid is also supplied under pressure. The pressures can be regulated by adjusting the gear pump 72 or the pressure reducing valve 77, it being known that the more air is added to the liquid, the drier the foam will be, and vice versa.

Figure 2:
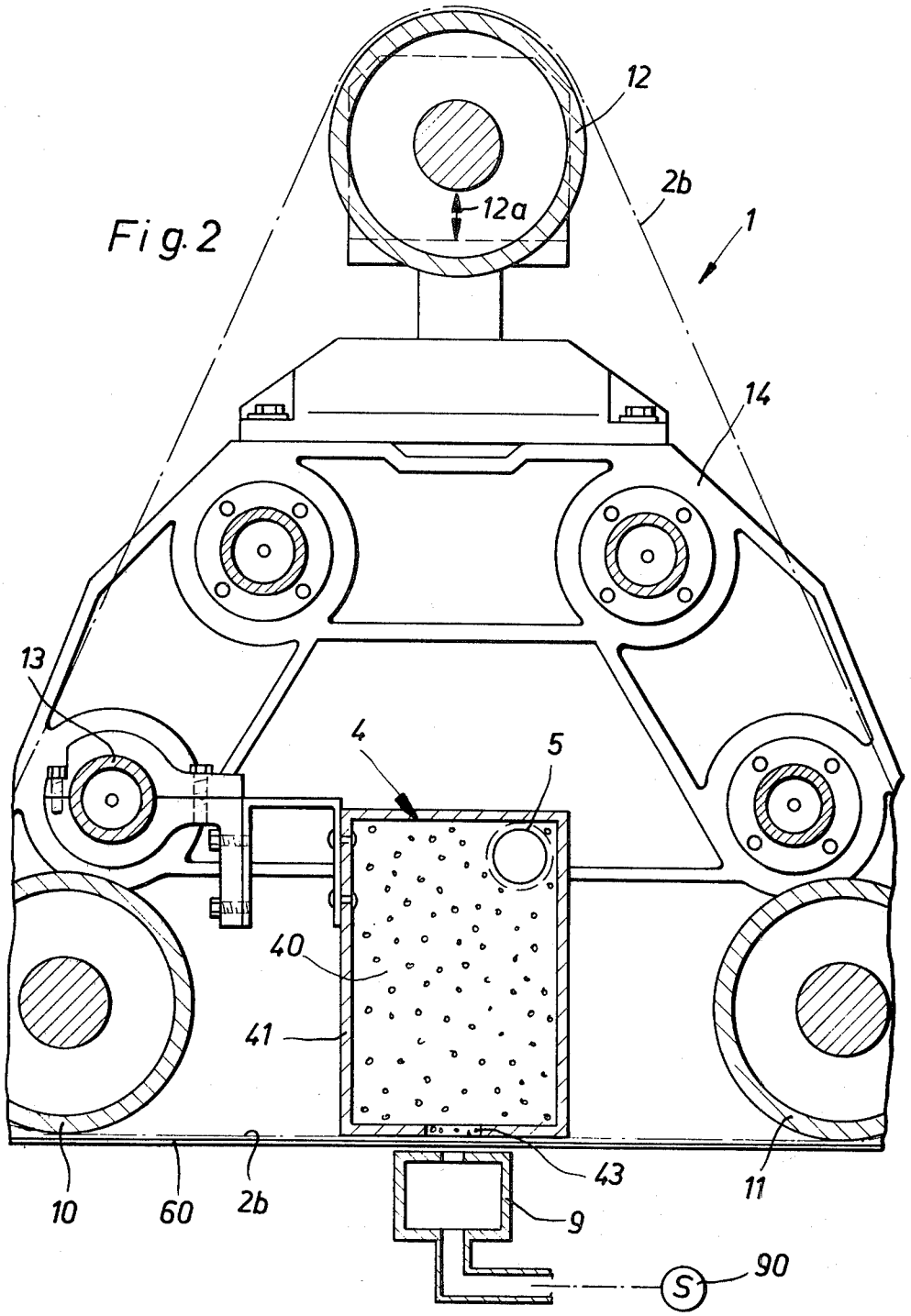
FIG. 2 is a partly sectional side view of a screen-printing station embodying the invention, showing a lateral bearing head of the station.

In the embodiment of FIG. 2 the screen 2*b* is an endless belt-type screen which is trained about rollers 10, 11 and 12. Two of these, e.g. 10 and 11, may be driven; the third, e.g. 12, may serve to tension the screen as indicated by arrows 12*a*. The printing station 1 has two lateral bearing heads 14 (one shown) which are connected by a traverse member 13. Mounted on this member 13 is a container 4 which extends over the entire working width of the screen 2*b* (i.e. in direction normal to the plane of FIG. 2). Also mounted on traverse member 13 is the foam supply device 5, e.g. a pipe which extends throughout the length of the container 4 and has foam outlets, or which is of one or two parts extending into one or both ends of the container 4.

The container 4 has an interior chamber 40 which is under pressure from the incoming foam which requires, of course, that the container be bounded by closed walls at all sides. Only the bottom wall facing the screen 2*b* is provided with a slot-like opening 43 through which the pressurized foam is expelled from chamber 40 and passes through screen 2*b* (under simultaneous bursting of the foam bubbles and liberation of their entrained liquid) onto the workpiece 60. The latter may be supported on a not-illustrated printing blanket.

However, it is also possible for the bottom wall of the container 4 to be entirely open to the screen 2*b;* the reason for this is that foam, even when under pressure, does not run as readily through the screen as printing ink or paste would do. Also, a suction box 9 (known per se) may be arranged beneath the screen 2*b;* the box 9 may have a suction slot through which it draws air out of the workpiece 60 (usually a textile material, such as e.g. carpeting) and thus facilitates entry of the liquid into the workpiece. Suction box 9 is connected with a vacuum pump 90; it may be used in addition to the pressurized chamber 40 or as an alternative if the foam is supplied to chamber 40 in pressure-free condition.

Figure 3:
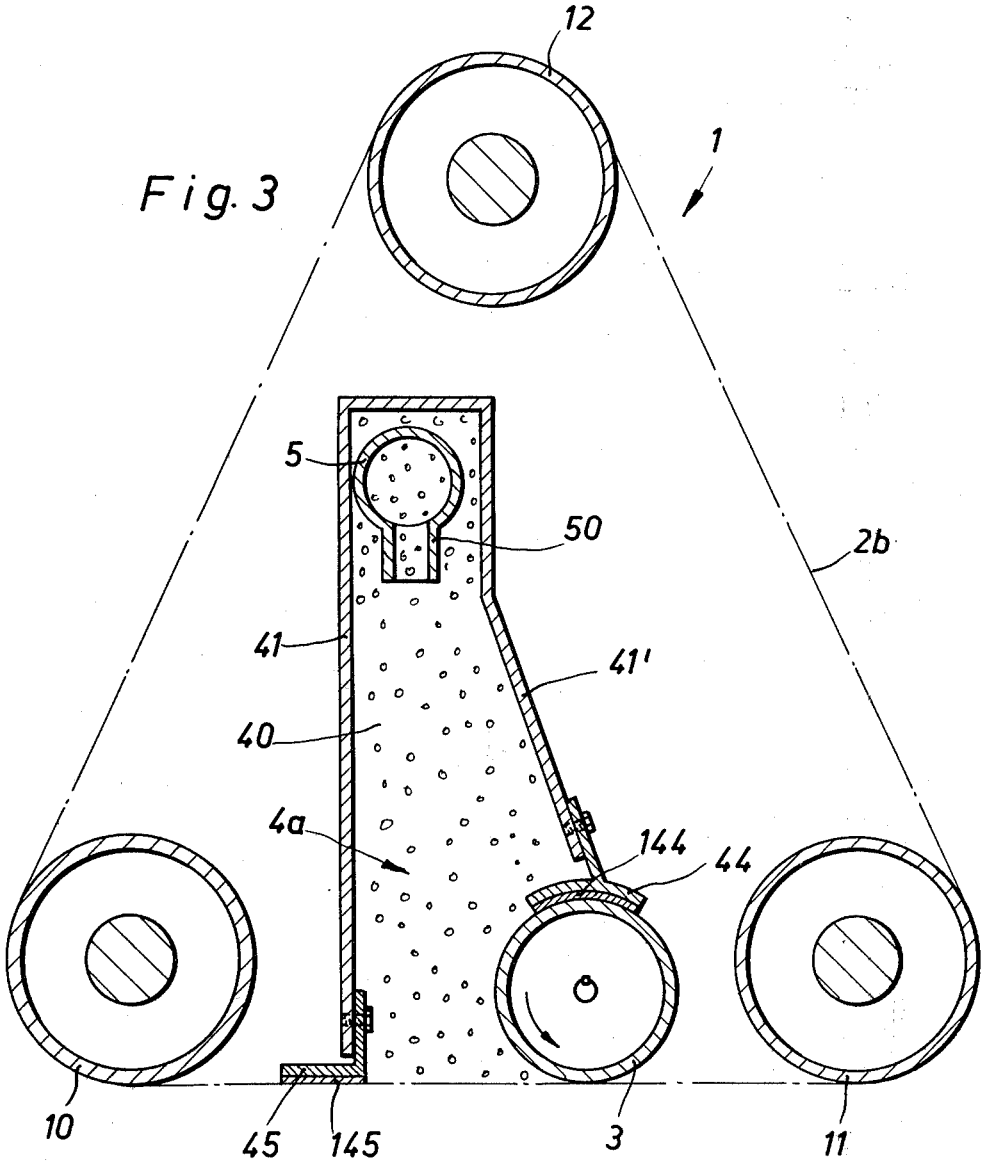
FIG. 3 is a view similar to that of FIG. 2 but more diagrammatic, illustrating another embodiment.

In the embodiment in FIG. 3 like reference numerals identify like elements as in FIG. 2. Here, however, the container 4*a* is integrated with an applicator device 3 which is in form of a roller squeegee. The upstream wall 41 of the container 4*a* (as considered in direction of screen movement) carries at its lower end an angle member 45 and a sealing element 145 in sliding contact with the screen 2*b*. The downstream wall 41' carries at its end a shoe 44 which rides on the circumference of the roller 3 and is sealed relative thereto by a sealing element 144. Thus, overflowing of medium behind the roller 3—where it could pass in uncontrolled manner through the screen and smear the prepared (e.g. printed) workpiece surface, is precluded. The foam supply pipe 5 extends into container 4*a* and has a plurality (one shown) of outlet nipples.

Figure 4:
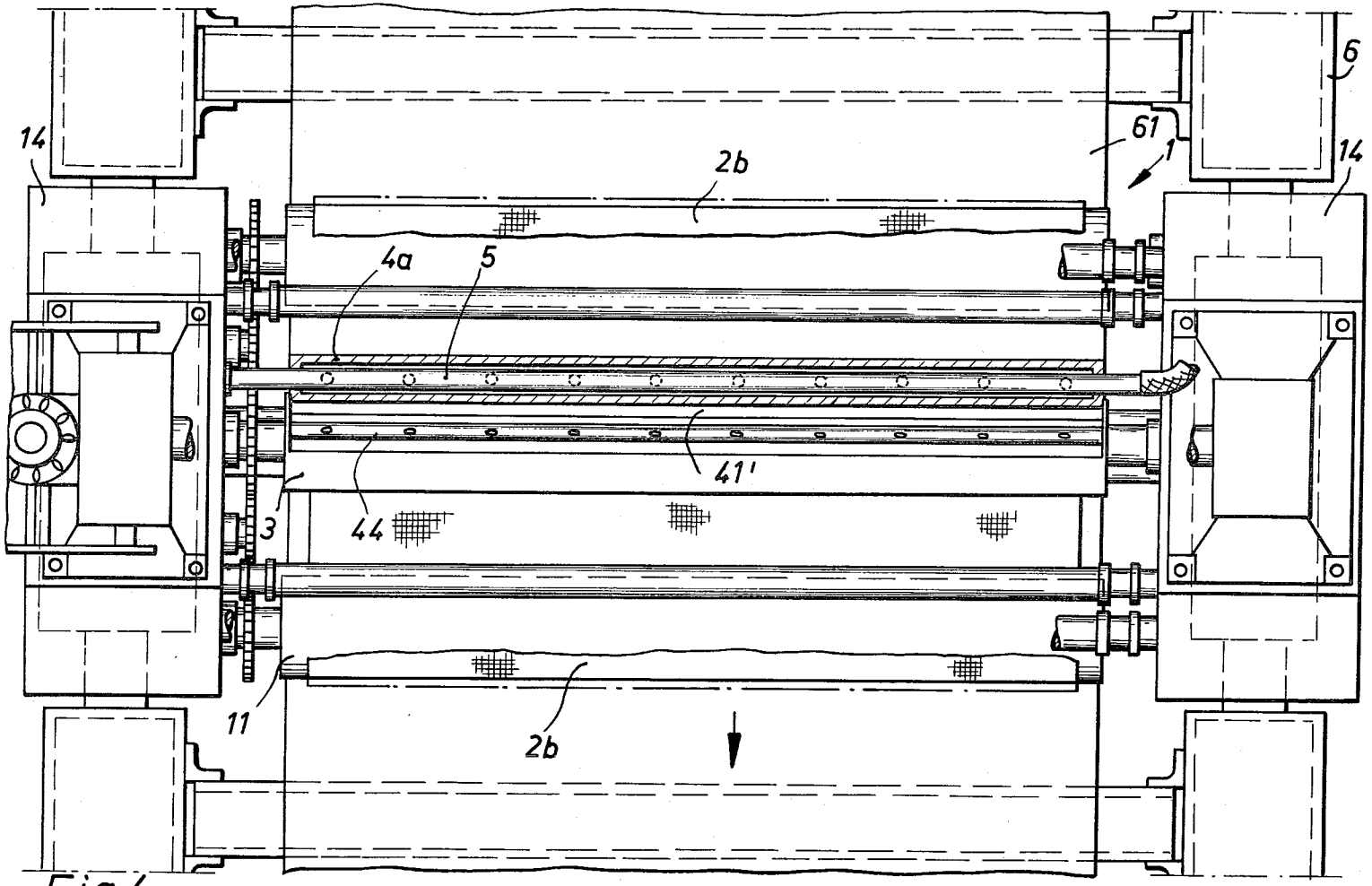
FIG. 4 is a top plan view, partly in section, of the embodiment of FIG. 3.

FIG. 4 is a top plan view of FIG. 3 and shows that the printing station 1 is supported on a frame 6 of a printing machine over which the workpiece (not shown) and a printing blanket 61 travel in the direction of the arrow. The pipe 5 sealingly engages the side walls of container 4*a*. The lateral bearing heads 14 mount the traverse members, the drives for the rollers 10, 11 and for the roller 3.

Figure 5:
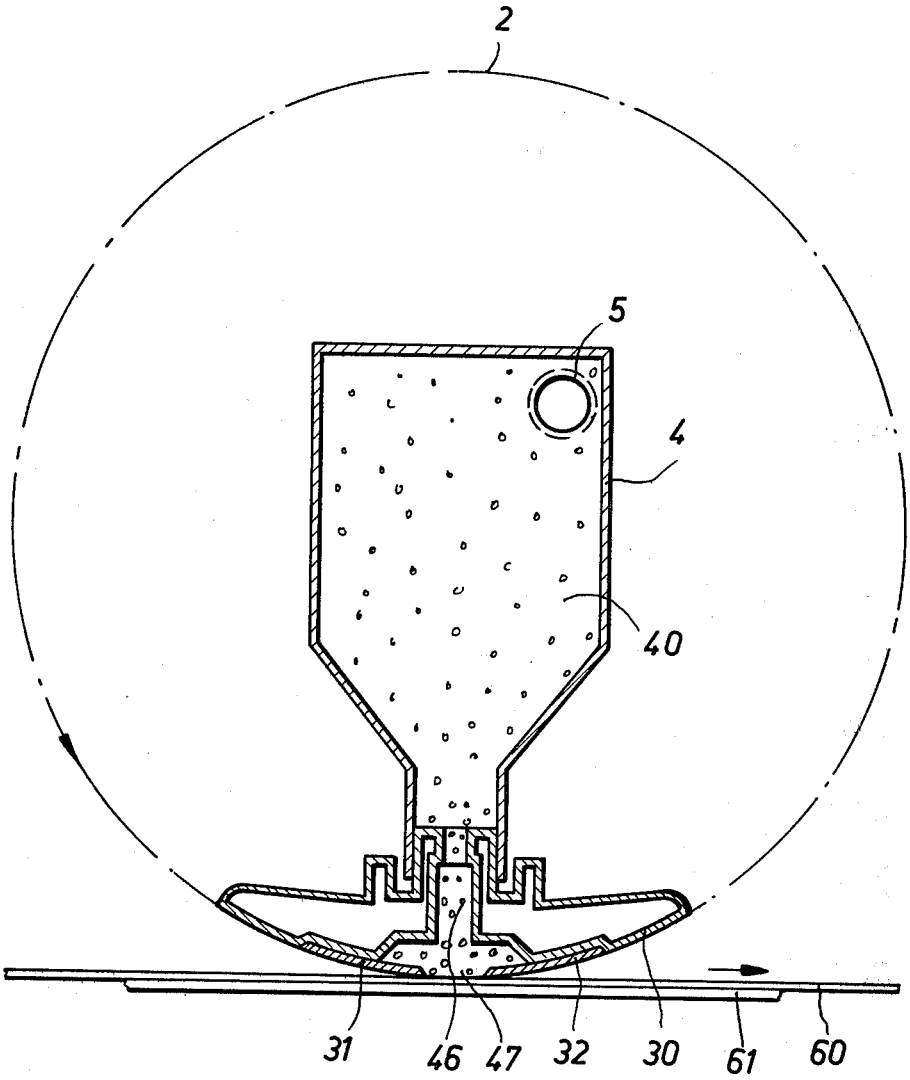
FIG. 5 is a diagrammatic side elevational view, in section, illustrating an additional embodiment of the invention.

The embodiment of FIG. 5, finally, shows a drum-type rotary screen 2 similar to the one in FIG. 1. Container 4 is located in its interior with its lower end out of contact with the screen, so that a squeegee shoe 30 can be detachably interposed between container 4 and screen 2. The foam supply device 5 is in form of a pipe or hose; it is connected with the mixing head 70 (FIG. 1) and fills the chamber 40 with foamed medium. This foamed medium flows via slots 46, 47 and two squeegee lips 31, 32 onto the inner surface of screen 2, where the bubbles burst and liberate their liquid for passage through the screen 2 and onto the workpiece 60. Again, a suction box (not shown) may be provided.

The use of foamed medium, specially under pressure, requires a substantial amount of space in the container 4. According to the invention it is therefore important, if drum-type screens 2 are used as e.g. shown in FIG. 5, that these have a diameter greater than 800 mm, preferably 1000 mm, 1200 mm or even more, so that the container 4 and the device 5 with associated components have adequate space for their installation. This is also important if additional space is needed, e.g. for a shuttling supply device 5 (i.e. one which moves to and fro) or a foam supply nozzle in the interior of container 4 or adjacent one of the container walls. If the invention is used with flat screens, then the screen will as a rule be stationary and the container 4 with the supply device 5 and the applying device (e.g. squeegee) will shuttle to and fro over the screen.

The invention has hereinbefore been described with reference to exemplary embodiments. However, variations and modifications will offer themselves to those skilled in the art and all such are intended to be encompassed within the scope of protection of the appended claims.

To summarize the basic considerations behind the invention:

It is exceedingly difficult and just about impossible to evenly distribute small quantities of treating medium (especially liquid) over the surface of a workpiece web. This is possible only by foaming the medium. Foaming alone, however, is still not sufficient to achieve the intended purpose: uniform distribution of small quantities of treating liquid over the workpiece surface is possible only if the foam is reconverted to liquid state—and this is possible with the desired uniformity only if a screen is interposed between the foam and the workpiece surface—so that the medium is applied to the workpiece through the screen.

The foam is pressed (e.g. via a squeegee) or sucked (e.g. via a suction box) through the screen. In so doing the main constituent component of each foam bubble, i.e. the treating liquid, is reconverted to liquid state and the quantity of liquid thus liberated is uniformly distributed over or in the workpiece, over the entire working width of the screen.

The foam bubbles may either be totally destroyed at or near the foam/screen interface, in which case the thereby liberated liquid reaches the workpiece. Alternatively, the foam may only be partly destroyed; in that case, some liquid will be liberated for application to the workpiece. The remaining, non-destroyed bubbles of foam will pass through the screen and be carried along by the workpiece surface to either burst (and to liberate their entrapped liquid) or to become dried in collapsed but non-burst state due to the influence of air, drying, heating or the like, depending upon what equipment acts upon the workpiece downstream of the location of foam application. Another possibility is for most or all of the foam bubbles to pass through the screen in non-burst state and then to burst either on the workpiece surface or to collapse and become dried as mentioned before.

The foam itself may have many different consistencies, since the types of treating liquid used may vary, the degree of foaming may vary, and the like. Furthermore, the manner in which the foam is made to pass through the screen can be varied. The screen speed, workpiece speed and physical influences acting upon the foam can be varied. An important role is also played by the type by screen structure in respect to the size and shape of its openings, the thickness of the screen and its frictional resistance at the foam/screen interface, all of which can be varied by using different screens. Finally, the type, surface structure, previous surface treatment and absorption capability of the workpiece itself are parameters which influence the application of the medium. All of the aforementioned parameters are, in fact, freely selectable by a user.

The workpiece may be of a paper, glass, synthetic plastic material or fibrous material (such as textile, e.g. napped material such as carpeting). The treating medium may be of many different kinds. For example, a suitable synthetic plastic resin may be foamed in the presence of an appropriate solvent and may be applied through the screen to a glass workpiece, to a paper workpiece or the like. Chalk may be foamed and applied to a paper workpiece as a coating. If synthetic plastic is applied in foamed state to paper, expecially absorbent paper, then it can be applied in sufficient quantity to penetrate into the paper. Latex can be foamed also and applied in the inventive manner to e.g. a textile workpiece as a coating; in this instance it may be advantageous to maintain the foam bubbles in unburst state to the maximum extent possible and to let them become dried or polymerized on the workpiece surface. Evidently, it is possible to coat, print or cover only portions of the workpiece surface, rather than the entire surface, irrespective of the medium used.

The screen or sieve is preferably supported by the surface of the workpiece.

What is claimed is:

1. Apparatus for applying a foamed treating medium to a workpiece, comprising a screen arranged to be located above a workpiece; first means defining above said screen an enclosed space having a predetermined volume and an opening facing said screen, the opening being closed by the workpiece and screen; second means communicating with said space for admitting a foamed treating medium into the same essentially uniformly within said enclosed space; and third means for foaming a treating medium and for supplying the foamed treating medium in adjustable quantities of liquid in the foam and volumes of gas in the foam to said second means so as to establish and maintain in said space an essentially constant pressure.

2. Apparatus as defined in claim 1, said third means comprising a mixing head, means for supplying liquid treating medium to said mixing head, means for supplying a compressed gas to said mixing head, and conduit means connecting said mixing head with said supplying means.

3. Apparatus as defined in claim 2; and further comprising flow control devices interposed in said conduit means and individually adjustable for controlling the flow of liquid and gas to said mixing head per unit of time.

4. Apparatus as defined in claim 1, said first means being a container having a lower region facing said screen and provided with a foam outlet extending over the entire working width of said screen and constituting said opening, and said second means extending into said container.

5. Apparatus as defined in claim 4; wherein said screen is a mobile screen and further comprising an applicator device located at the downstream side of said container, as considered in the direction of screen movement, said applicator device being integrated into said container.

6. Apparatus as defined in claim 1, said second means extending lengthwise through said space.

7. Apparatus as defined in claim 1, said second means being a pipe provided with longitudinally spaced foam outlets.

8. Apparatus as defined in claim 1, said container having a lower region facing but spaced from said screen; and further comprising an applicator device in form of a squeegee shoe removably mounted on said lower region in the space between the space and said screen.

9. Apparatus as defined in claim 8, said squeegee shoe having squeegee lips.

10. Apparatus as defined in claim 1, said screen being a rotary drum-type screen and said first means being located within the confines of said screen, said screen having a diameter in excess of 800 mm.

11. Apparatus as defined in claim 1, said screen having a diameter at least equal to 1000 mm.

* * * * *